US008555539B2

(12) United States Patent
Pflaumer et al.

(10) Patent No.: US 8,555,539 B2
(45) Date of Patent: Oct. 15, 2013

(54) TRIGGER SYSTEM

(75) Inventors: Wulf Heinz Pflaumer, Arnsberg (DE); Franz Wonisch, Arnsberg (DE); Stefan Eith, Neu-Ulm (DE); Martin Werner, Elchingen (DE)

(73) Assignee: Carl Walther GmbH, Ulm (DE)

( * ) Notice: Subject to any disclaimer, the term of this patent is extended or adjusted under 35 U.S.C. 154(b) by 100 days.

(21) Appl. No.: 13/293,176

(22) Filed: Nov. 10, 2011

(65) Prior Publication Data

US 2012/0204462 A1 Aug. 16, 2012

(30) Foreign Application Priority Data

Nov. 10, 2010 (DE) ..... 10 2010 050 904

(51) Int. Cl.
*F41A 19/10* (2006.01)
*F41A 19/14* (2006.01)
*F41A 19/12* (2006.01)

(52) U.S. Cl.
USPC ..... 42/69.01

(58) Field of Classification Search
USPC ..... 42/69.01–69.03
See application file for complete search history.

(56) References Cited

U.S. PATENT DOCUMENTS 2,259,404 A * 10/1941 Fritz ..... 89/147
5,806,225 A * 9/1998 Gardner et al. ..... 42/69.02
5,906,191 A * 5/1999 Wonisch et al. ..... 124/31
6,029,645 A * 2/2000 Wonisch et al. ..... 124/74
7,500,327 B2 * 3/2009 Bubits ..... 42/69.02
7,617,628 B2 * 11/2009 Curry ..... 42/70.02
8,033,043 B2 * 10/2011 McGarry ..... 42/70.08
8,176,836 B2 * 5/2012 Peev ..... 89/147
8,418,391 B2 * 4/2013 Kemmerer et al. ..... 42/70.05
2005/0034345 A1 2/2005 Beretta
2011/0061280 A1 * 3/2011 Emde et al. ..... 42/70.06
2013/0019510 A1 * 1/2013 Kemmerer et al. ..... 42/1.01
2013/0125441 A1 * 5/2013 Westwood et al. ..... 42/70.05

FOREIGN PATENT DOCUMENTS

DE 10 2005 046877 A1 4/2006

* cited by examiner

*Primary Examiner* — Michael David
(74) *Attorney, Agent, or Firm* — Bachman & LaPointe, P.C.

(57) ABSTRACT

In a trigger system (100) comprising a hammer (110) for firing a cartridge, a striker (120) adapted to accelerate the hammer (110), and a sear (130) for releasably locking the striker (120), which sear (130) can be unlocked by means of a release device (140) capable of being actuated by means of a trigger bar (160) that can be moved by a trigger (150), wherein a front surface (121) of the striker rests against an end face (111) of the hammer for the purpose of accelerating the hammer (110) to initiate firing, protection of the cocked hammer (110) from external mechanical influences is made possible by mounting the hammer (110), the striker (120), the release device (140), and also a main spring (170) adapted to accelerate the striker (120) for rotation about a common principal axis (180).

18 Claims, 9 Drawing Sheets

TRIGGER SYSTEM

CROSS-REFERENCE TO RELATED APPLICATION

Priority is claimed of DE102010050904.3-15, filed Nov. 10, 2010, the disclosure of which is incorporated by reference herein in its entirety as if set forth at length.

BACKGROUND OF THE INVENTION

The invention relates to a trigger system comprising a hammer for firing a cartridge, a striker adapted to accelerate the hammer, and a sear for releasably locking the striker, which sear can be unlocked by means of a release device capable of being actuated by means of a trigger bar that can be moved by a trigger, wherein a front surface of a striker rests against an end face of the hammer for the purpose of accelerating the hammer for firing a shot.

Trigger systems of the above type are configured in the prior art as double-action systems, which are more elaborately designed than single-action systems in which a cocking operation is to be manually carried out prior for firing a shot.

The prior devices are usually configured for use in firearms equipped with flybolts as cartridge firing elements and they all exhibit the drawback that they are labor-intensive in production and are thus relatively expensively.

SUMMARY OF THE INVENTION

It is thus an object of the invention to provide a cheap, non-precockable trigger system of robust, compact, and lightweight design and with the assistance of which a handgun equipped with a hammer as the cartridge firing element can be fabricated so as to satisfy increased safety requirements.

For a trigger system of the above type, this object is achieved, according to the invention, in that the hammer, the striker, the release device, and also a main spring for biasing the striker are mounted for rotation about a common principal axis.

Preferred embodiments of the invention are the subject matter of the subordinate claims.

In the case of the trigger system of the invention the following combination of features, to the effect that the hammer, the striker, the release device, and also a main spring for biasing the striker are mounted for rotation about a common principal axis, makes it possible to design the assembly such that not only a decocked hammer but also a cocked hammer can be disposed in a rest position covered by the handgun handle, in which position the hammer does not project beyond the handle and is thus safely protected from external mechanical influences.

According to a first preferred embodiment of the trigger system of the invention provision is made for an operational angle of from 0° to 40°, more particularly of approximately 20° to be formed between a front surface of the striker and an end face of the hammer in a rest position of the hammer prior to actuation of the trigger, with the result that a rear rear edge of the hammer in the rest position assumes an angular position in the range of from 0° (vertical) to ±10°.

Prior to firing, the entrainer of the trigger bar moves forward due to actuation of the trigger and thus allows the hammer to rotate under the action of a release spring so as to move from its rest position, in which the front surface of the striker is spaced from the end face of the hammer at an angle of from 0° to 40°, more particularly at 20°, to a firing position, in which the front surface of the striker assumes a position in the region of the end face of the hammer.

In an operation subsequent to cocking the main spring by means of the breech block moving the hammer rearwardly, the entrainer, due to the action of a trigger spring moving the trigger back to its rest position, rotates the hammer about the principal axis until a specified operational angle between the end face of the hammer and the front surface of the striker is formed.

According to another preferred embodiment of the trigger system of the invention provision is made for the trigger, when moved from a rest position to a release position, to cause a forward movement of the entrainer of the trigger bar from its position adjacent a lower operational edge of the release device and thus rotation of the release device in a clockwise direction, by which means a releaser protuberance formed on the trigger strikes upwardly against the sear and thus disengages a striker catch from a sear edge.

In an operation subsequent to unlocking the striker, the striker biased by the main spring accelerates rotation of the hammer by causing the front surface of the striker to press against the end face of the hammer to cause rotation of the hammer.

According to another preferred embodiment of the trigger system of the invention provision is made for the breech block to contain a trigger bar slide, which, when the breech block moves rearwardly as a result of firing a shot, cooperates with a cam formed on the trigger bar, in order to press the cam and thus the trigger bar downwardly and by this means to disengage the entrainer of the trigger bar from engagement with the operational edge of the release device. By this means complete unlocking of the entrainer of the trigger assembly is achieved such that, in particular, even an extensive forward movement of the hammer slide protuberance will not be obstructed by the entrainer.

In an operation subsequent to firing a cartridge, a projectile moves forward from the barrel of the handgun and the cartridge case disposed in the breech block and absorbing the impulse of the projectile executes a corresponding rearward movement, which accelerates the breech block rearwardly.

The hammer can be moved rearwardly by a breech block moving to the rear and can thus be rotated about the principal axis, the end face of the hammer being preferably pressed against the front surface of the striker and the striker likewise caused to rotate, as a result of which the main spring is cocked by the tensioning cam of the rotating striker.

During a rearward movement of the breech block, a trigger bar slide cooperates with a cam formed on the trigger bar to press the cam and thus the trigger bar downwardly and by this means to disengage the entrainer of the trigger bar from the operational edge of the release device, in order that the action of the release spring can initiate rearward rotation of the release device, by means of which the releaser protuberance can be returned to a rest position, in which the striker catch is locked in position by the sear edge.

The release spring is likewise mounted for rotation about the common principal axis and can be rotatively cocked and biases, with its first end, the stop member of the hammer in the direction of the entrainer of the trigger bar and, with another end, presses the trigger into a position in which the cocked striker can be blocked by means of the sear.

According to another preferred embodiment of the trigger system of the invention provision is made for a hammer slide protuberance disposed opposite an impact surface of the hammer to be capable of moving forward by a rearward movement of the hammer in order to press the adjacent entrainer and thus the trigger bar forward against the force of a trigger spring.

According to another important preferred embodiment of the trigger system of the invention provision is made to the effect that during a forward movement of the breech block caused by the action of a breach spring, the trigger bar slide causes, together with an entrainer spring, a rearward upward movement of the entrainer, wherein the entrainer as a result slides upwardly along the hammer slide protuberance whilst pressing against the hammer slide protuberance.

Preferably, the entrainer of the trigger bar presses, by the action the trigger spring, the hammer slide protuberance rearwardly, in order to urge the hammer to rotate forward toward its rest position.

The benefit of the trigger system of the invention is that the rest position of the rear edge of the hammer can be adjusted by adaptation of the length of the trigger bar and thus of the relative position of the entrainer with reference to the hammer slide protuberance and of the geometry of the hammer slide protuberance in the range of from 0° (vertical) to ±10°.

The sear used in connection with the trigger system of the invention is mounted for rotation about a sear axis parallel to the principal axis.

BRIEF DESCRIPTION OF THE DRAWINGS

The trigger system of the invention is explained below with reference to a preferred embodiment illustrated in the figures of the drawings.

DETAILED DESCRIPTION

Figure 1:
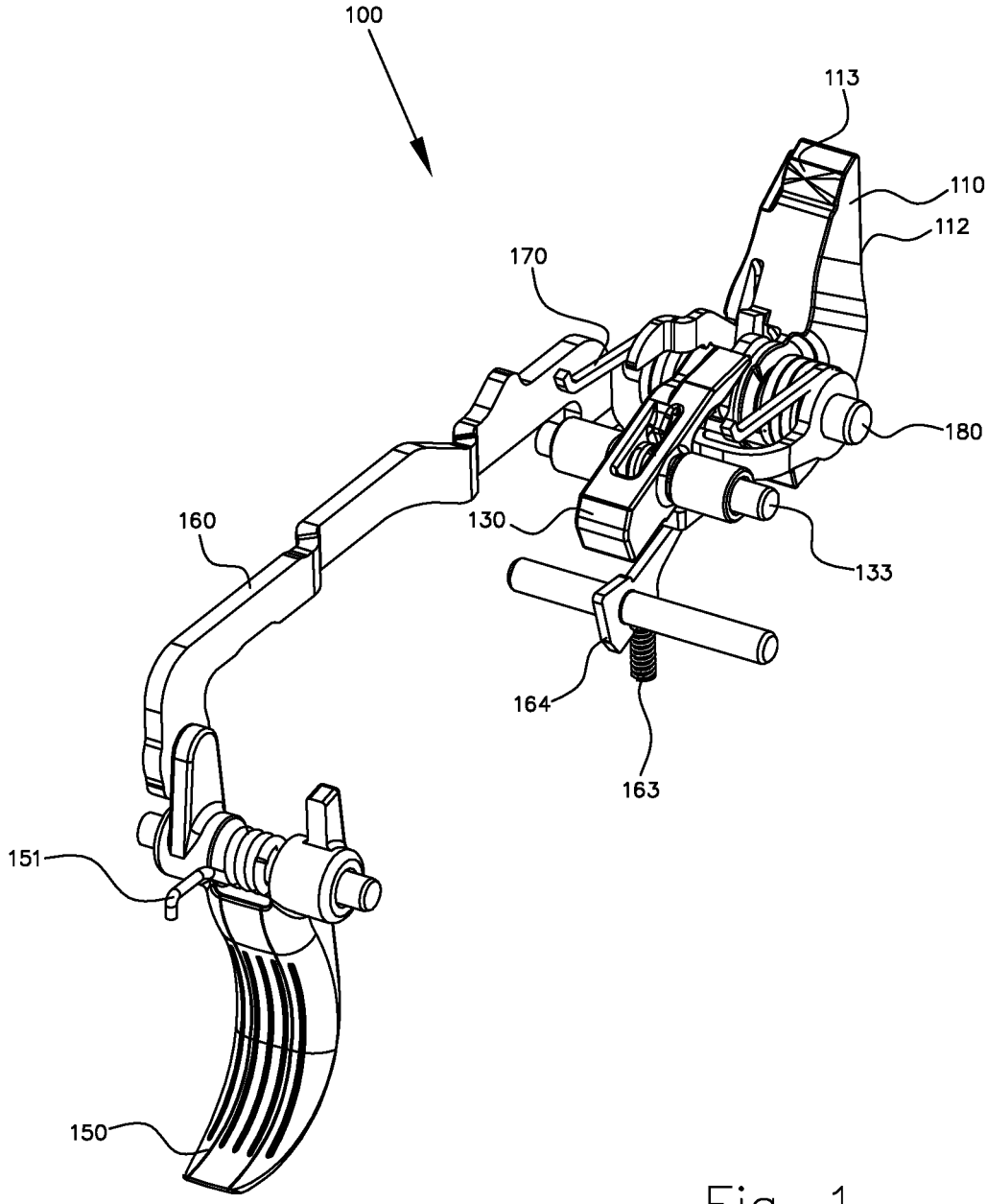
FIG. 1 shows a preferred embodiment of the trigger system of the invention in an oblique front view in a rest position of the hammer.
Figure 2:
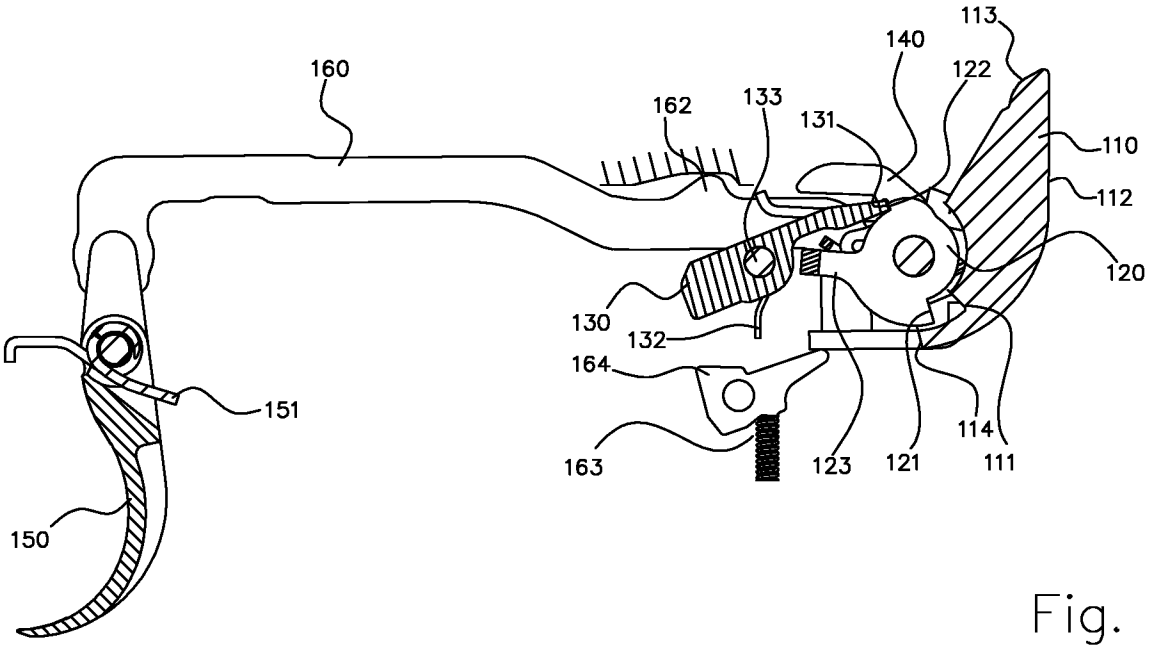
FIG. 2 is a side view of the preferred embodiment of the trigger system of the invention illustrated in FIG. 1 in a rest position of the hammer.
Figure 3:
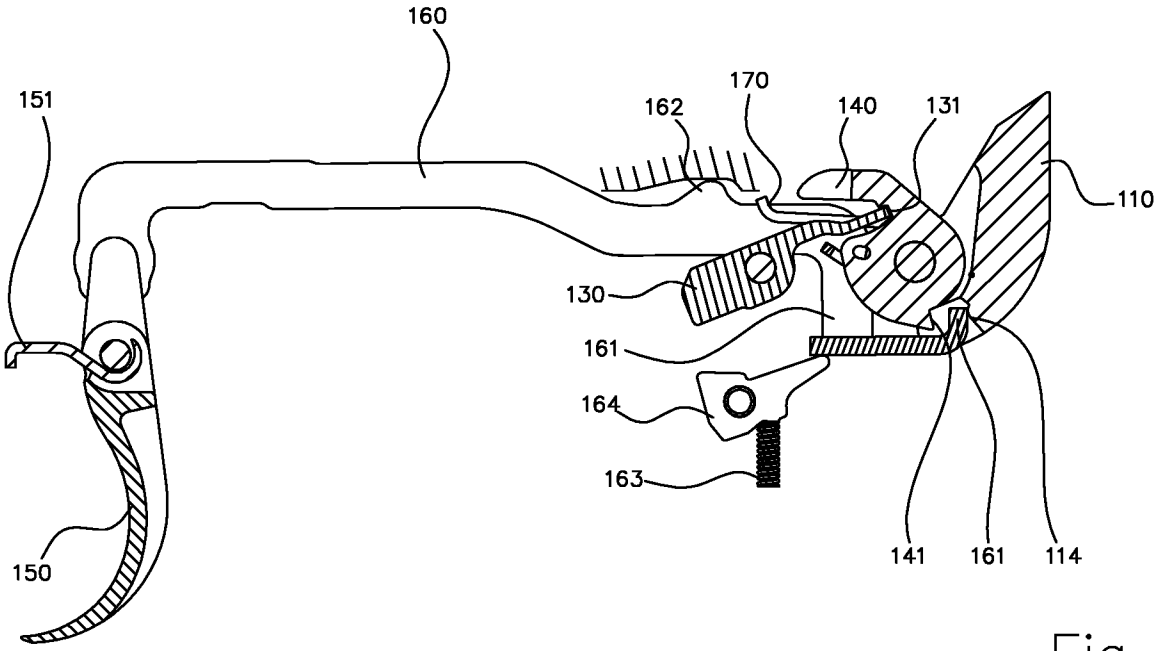
FIG. 3 is another side view of the preferred embodiment the trigger system of the invention illustrated in FIG. 1 in a rest position of the hammer.
Figure 4:
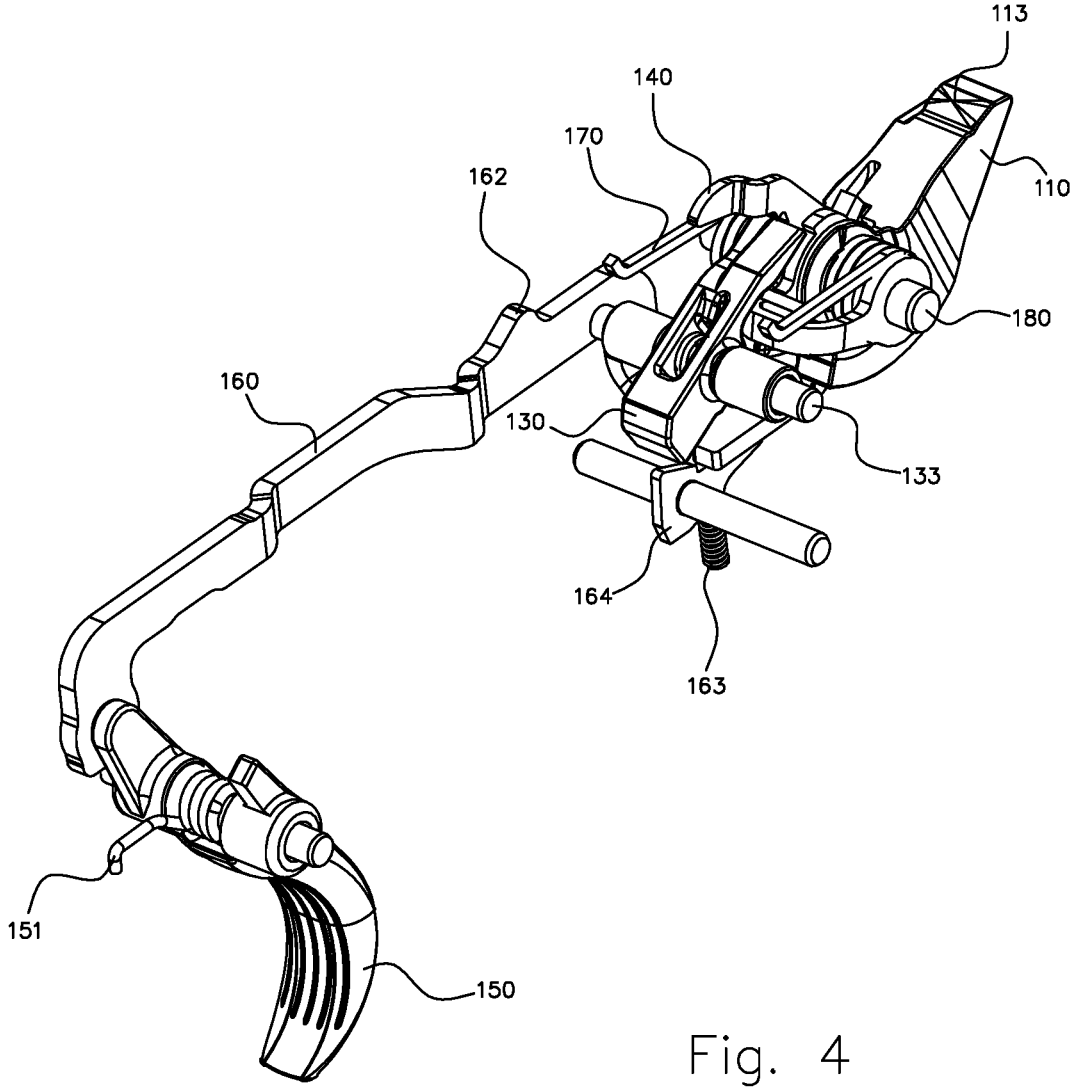
FIG. 4 is an oblique front view of the preferred embodiment of the trigger system of the invention illustrated in FIG. 1 in a cocked position of the hammer.
Figure 5:
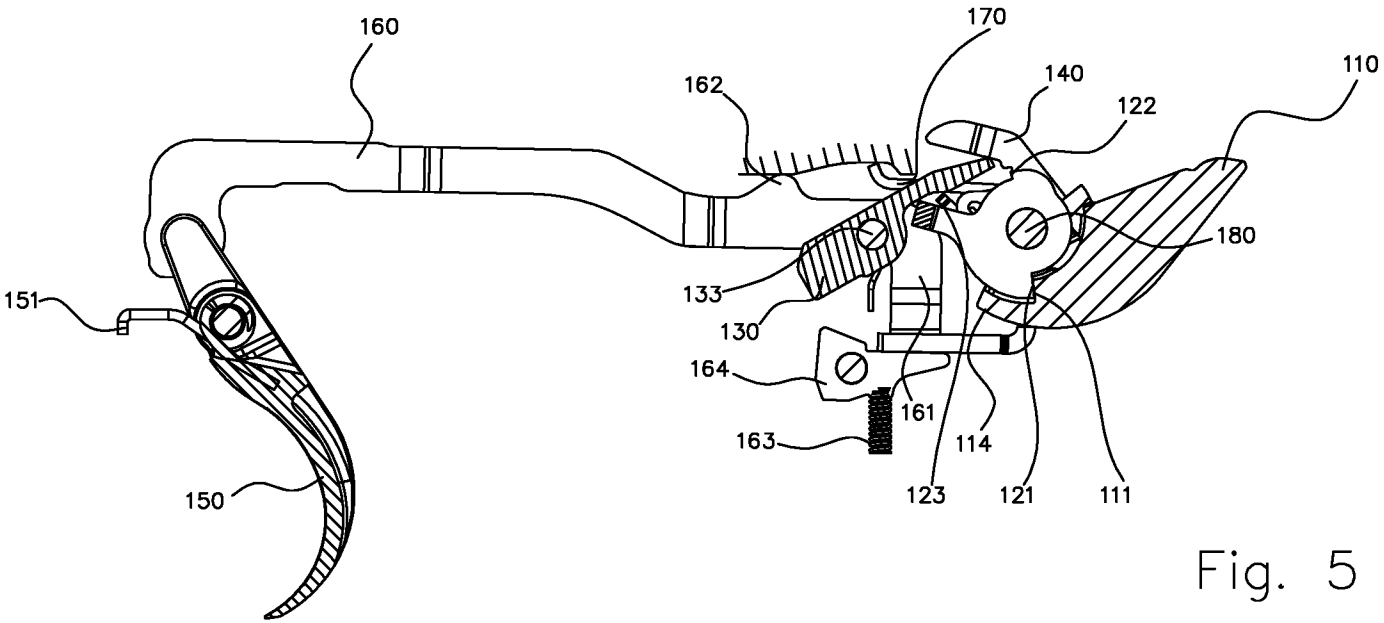
FIG. 5 is a side view of the preferred embodiment the trigger system of the invention illustrated in FIG. 1 in a cocked position of the hammer.
Figure 6:
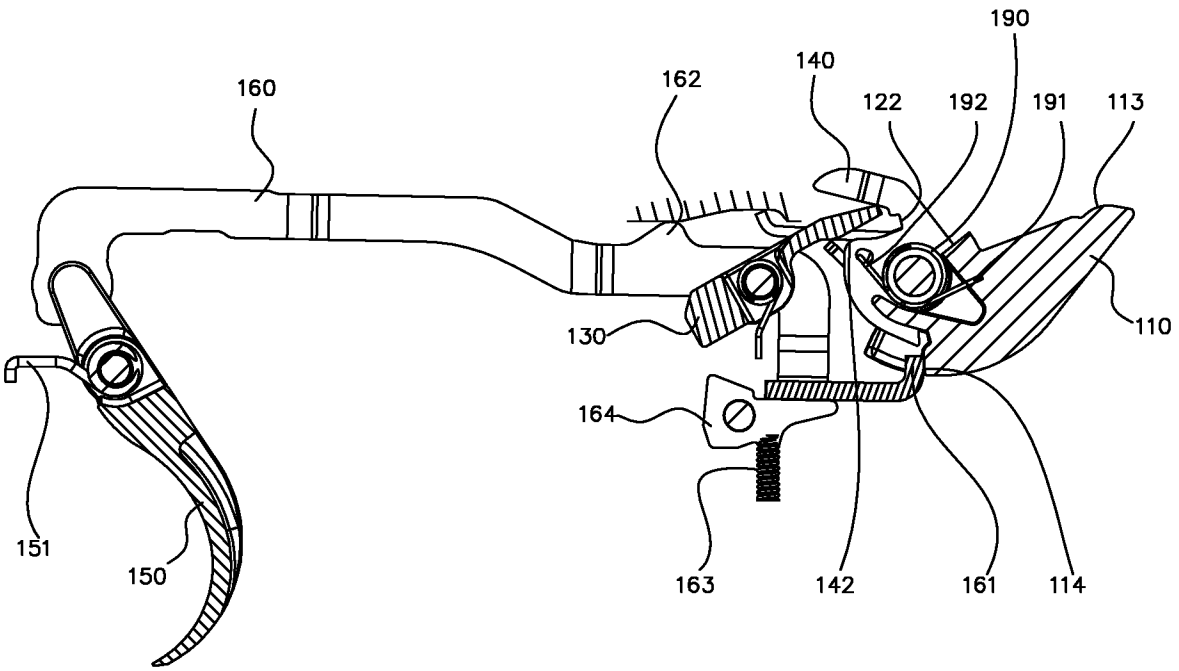
FIG. 6 is another side view of the preferred embodiment the trigger system of the invention illustrated in FIG. 1 in a cocked position of the hammer.
Figure 7:
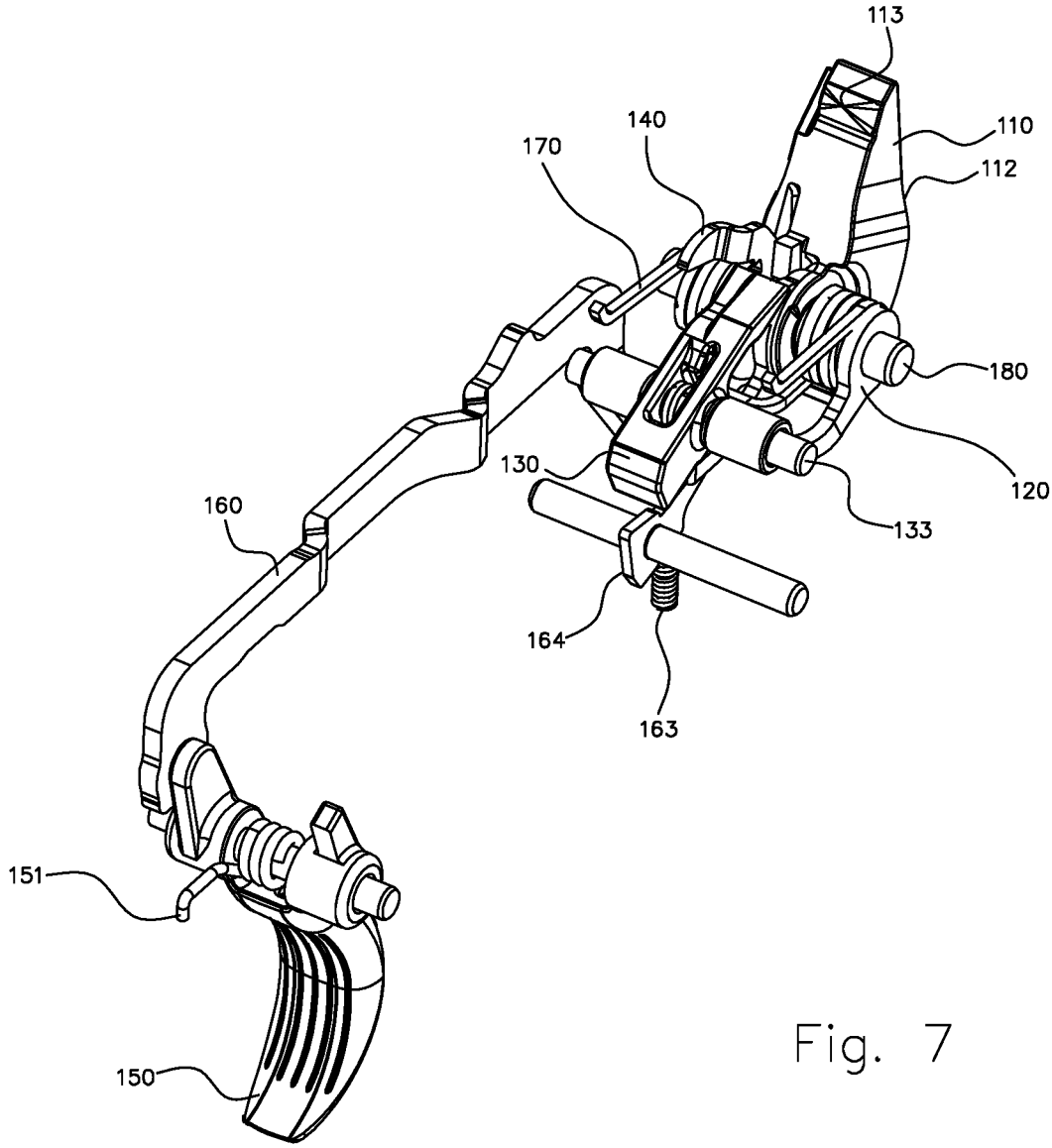
FIG. 7 is an oblique front view of the preferred embodiment the trigger system of the invention illustrated in FIG. 1 in a firing position of the hammer.
Figure 8:
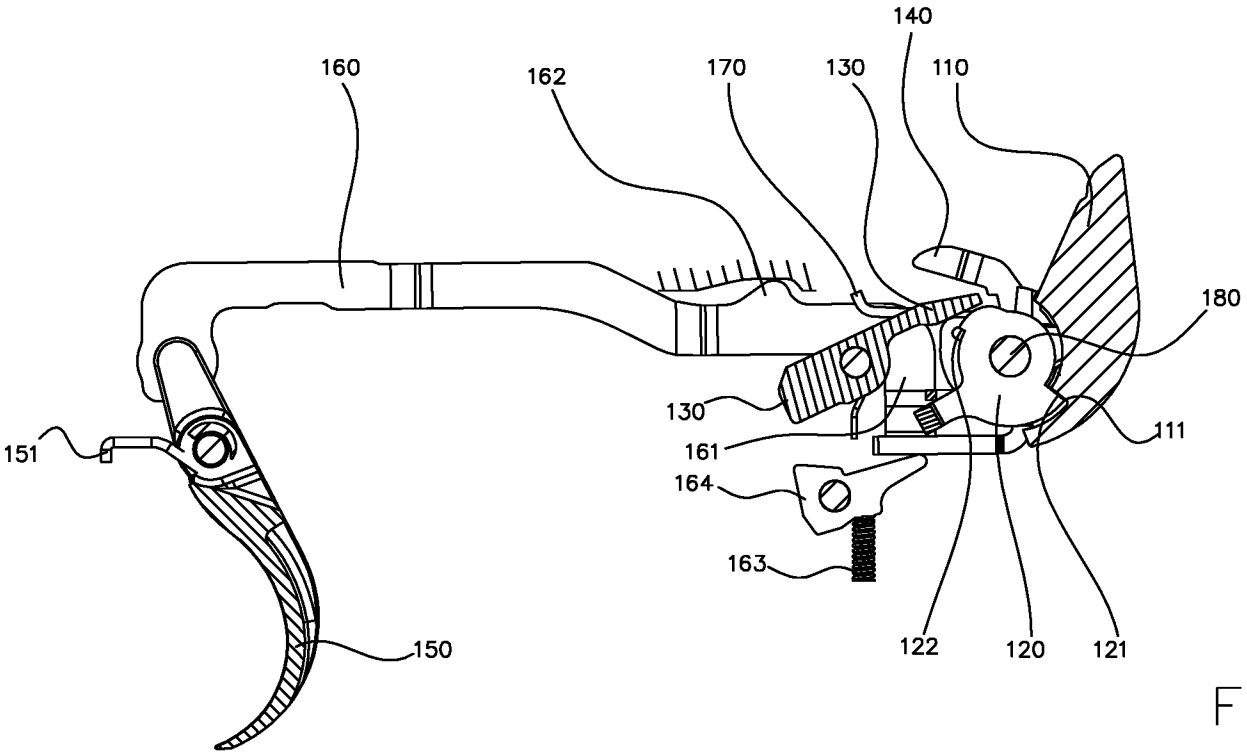
FIG. 8 is another side view of the preferred embodiment the trigger system of the invention illustrated in FIG. 1 in a firing position of the hammer.
Figure 9:
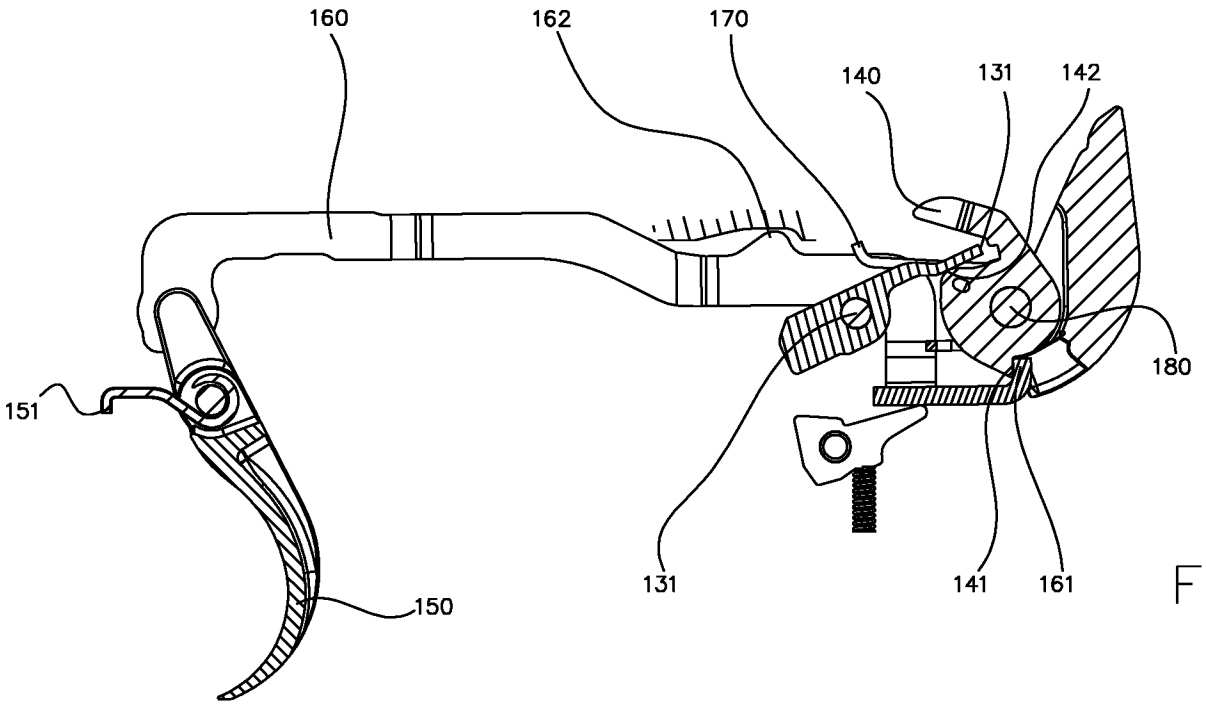
FIG. 9 is another side view of the preferred embodiment the trigger system of the invention illustrated in FIG. 1 in a firing position of the hammer.

The trigger system 100 of the invention illustrated in FIGS. 1 to 9 includes a hammer 110 for firing a cartridge, a striker 120 for accelerating the hammer 110, and a sear 130 for releasably locking the striker 120, which is releasable by means of a release device 140. The release device 140 can be activated by means of a trigger bar 160 capable of being moved by means of a trigger 150 and a front surface 121 of the striker rests against an end face 111 of the hammer for the purpose of accelerating the hammer 110 in order to initiate firing.

The hammer 110, the striker 120, a main spring 170 biasing the striker 120, and the trigger 140 are mounted for rotation about a common principal axis 180, wherein, in a rest position of the hammer 110, prior to actuation of the trigger 150, an operational angle of 20 is formed between a front surface 121 of the striker and an end face 111 of the hammer with the effect that in the rest position, the hammer 110 shows an angle of inclination in the region of 0, i.e. with its rear edge 112 being vertical.

The sear 130 is mounted for rotation about a sear axis 133 that is parallel to the principal axis 180.

Following cocking of the main spring 170 by means of the breech block to pull back the hammer 110, the entrainer, due to the action of a trigger spring 151 adapted to return the trigger 150 to its rest position, rotates the hammer 110 about the principal axis 180 to such an extent that the specified operational angle between the end face 111 of the hammer and the front surface 121 of the striker is formed.

Below, the terms "forward" and "rearward" movement denote movement in the shooting direction and contrariwise respectively.

An "upward" movement denotes movement perpendicular to the shooting direction toward the breech block and a "downward" is a corresponding countermovement.

In a rest position of the trigger 150 a rotatively cockable trigger spring 151 causes a rearward movement of the trigger bar 160 and a forward movement of the trigger 150.

Firing is initiated by a forward movement of the trigger bar 160.

A linearly cockable entrainer spring 163 braced against the housing presses a biasing plate 164 (press plate) upwardly against the entrainer 161 on the trigger bar 160, by which means the entrainer 161 and trigger bar 160 can be moved downwardly and are biased upwardly.

A rotatively cockable sear spring 132 is braced at one end in a bore of the housing and biases a sear projection 131 toward a striker catch 122.

A rotatively cockable main spring 170 presses against a nose of a striker 120, which has on the opposite side thereof a projection that rests against an accelerating surface of the hammer 110.

In the rest position of the hammer, the main spring 170 is cocked and the sear spring 132 biases the sear edge 131 of the sear 130 toward a striker catch 122 of the striker 120.

The striker catch 122 is locked to the sear edge 131 and the striker 120 is blocked against rotation.

Prior to firing a shot, the entrainer 161 of the trigger bar 160 moves forward due to actuation of the trigger 150 and thus allows the hammer 110 to rotate under the action of a release spring 151 so as to move from its rest position, in which the front surface 121 of the striker is spaced from the end face 111 of the hammer at an angle of from 10° to 40°, more particularly at 20 degree, to a firing position, in which the front surface 121 of the striker assumes a position in the region of the end face of the hammer 111.

When a shot is fired, the entrainer 161 pertaining to the trigger bar 160 and resting against a lower operational edge 141 of the release device 140 moves forward and thus causes rotation of the release device 140 in a clockwise direction.

A releaser protuberance 142 formed on the release device 140 knocks upwardly against the sear 130 and thus unlatches the striker catch 122 from the sear edge 131.

Subsequently, the striker 120 biased by the main spring 170 rotates to accelerate the hammer 110 by pressing a front surface 121 of the striker against an end face 111 of the hammer to cause the hammer 110 to rotate counterclockwise.

The rotary movement of the striker 120 continues until a tensioning cam 123 pertaining to the striker 120 bears against a stop member formed in the handle.

The hammer 110 is at this stage situated in a firing position.

When the breech block moves rearwardly, the trigger bar slide presses the cam and thus the trigger bar 160 downwardly.

During the process of cocking the hammer 110, the entrainer 161 of the trigger bar 160 is prevented from engaging the operational edge of the release device 140 and is in this way decoupled from the trigger assembly.

The hammer 110 is subsequently forced back by the rearwardly moving breech block and thus caused to rotate in a clockwise direction, by which means the end face 111 of the hammer is pressed against the front surface 121 of the striker and the striker 120 is likewise caused to rotate in a clockwise direction.

Thus the main spring 170 is cocked by the tensioning cam 123 pertaining to the rotating striker 120.

During a rearward movement of the breech block, a trigger bar slide cooperates with a cam formed on the trigger bar 160 to depress the cam and thus the trigger bar 160 and thus to disengage the entrainer 161 of the trigger bar 160 from the operational edge of the release device 140.

By this means, the action of a release spring 190 initiates a rearward rotation of the release device 140 and the releaser protuberance 142 is returned to a rest position, in which locking of the striker catch 122 is effected by the sear edge 131.

The release spring 190 is likewise mounted for rotation about the common principal axis 180 and can be rotatively cocked so that its first end biases the stop member of the hammer 110 in the direction of the entrainer 161 of the trigger bar 160 and, with its other end, presses the release device 140 into a position in which the cocked striker 120 can be blocked by means of the sear 130.

Correspondingly, the sear edge 131 locks the striker catch 122 of the striker 120 during the rearward movement of the hammer 110.

A hammer slide protuberance 114 opposite the impact surface 113 of the hammer 110 moves due to the rearward movement of the hammer 110 in an counterclockwise direction and urges the entrainer 161 and thus the trigger bar 160 to move forward against the force of the trigger spring 190.

During a subsequent forward movement of the breech block, the trigger bar slide causes, in cooperation with an entrainer spring 163, an upward rearward movement of the entrainer 161, which consequently slides upwardly while pressing against the hammer slide protuberance 114 along the hammer slide protuberance 114 until the hammer 110 reaches its rest position of 0° inclination.

In the operation subsequent to the forward movement of the breech block, the entrainer of the trigger bar 161 presses, due to the action of the trigger spring 190, the hammer slide protuberance 114 rearwardly, by which means the hammer 110 is caused, by rotation in the counterclockwise direction, to move forward in the direction of its rest position.

The rest position of the hammer 110 is basically adjustable within the range of from 0° to 10° by adaptation of the length of the trigger bar 160 and thus of the relative position of the entrainer 161 with reference to the hammer slide protuberance 114 and also by adaption of the geometry of the hammer slide protuberance 114.

The exemplary embodiment of the invention that is explained above serves only the purpose of providing better comprehension of the teaching of the invention specified in the claims and is not, as such, restricted to the exemplary embodiment.

The invention claimed is:

1. A trigger system (100) comprising a hammer (110) for firing a cartridge, a striker (120) adapted to accelerate said hammer (110), and a sear (130) for releasably locking said striker (120), which sear (130) can be unlocked by means of a release device (140) capable of being actuated by means of a trigger bar (160) that can be moved by a trigger (150) wherein a front surface (121) of said striker rests against an end face (111) of said hammer for the purpose of accelerating said hammer (110) to initiate firing, characterized in that said hammer (110), said striker (120), said release device (140), and also a main spring (170) adapted to accelerate said striker (120) are mounted for rotation about a common principal axis (180).

2. The trigger system as defined in claim 1, characterized in that in a rest position of said hammer (110) and prior to actuation of said trigger (150), an operational angle is formed between a front surface (121) of said striker and an end face (111) of said hammer, with the result that a rear edge (112) of said hammer (110) assumes, in the rest position, an angle of inclination in the range of from 0° (vertical) to ±10°.

3. The trigger system as defined in claim 2, characterized in that said operational angle is between 10° and 40°.

4. The trigger system as defined in claim 1, characterized in that prior to the initiation of firing, an entrainer (161) pertaining to said trigger bar (160) is capable of being moved forward by actuation of said trigger (150), by which means rotation of the hammer (110) is made possible due to the action of a release spring (190) from its rest position, in which said front surface (121) of said striker is separated from said end face (111) of said hammer by an angle of from 10° to 40°, is carried out to achieve a firing position in which said front surface (121) of said striker comes to rest in the region of said end face (111) of said hammer.

5. The trigger system as defined in claim 1, characterized in that in an operation subsequent to cocking of the main spring (170) by means of a breech block moving said hammer (110) rearwardly, said entrainer, due to the action of a trigger spring (151) moving said trigger (150) back to its rest position, rotates said hammer (110) about said principal axis (180) until a specified operational angle between said end face (111) of said hammer and said front surface (121) of said striker is formed.

6. The trigger system as defined in claim 5, characterized in that said trigger (150), when moved from a rest position to a release position, causes a forward movement of said entrainer (161) pertaining to said trigger bar (160) from its position adjacent a lower operational edge (141) of said release device (140) and thus rotation of said release device (140) in a clockwise direction, by which means a releaser protuberance (142) formed on said release device (140) strikes upwardly against said sear (130) and thus disengages a striker catch (122) from a sear edge (131).

7. The trigger system as defined in claim 6, characterized in that in an operation subsequent to unlocking said striker, said striker (120) biased by said main spring (170) accelerates rotation of said hammer (110) by causing said front surface (121) of said striker to press against said end face (111) of said hammer to cause rotation of said hammer (110).

8. The trigger system as defined in claim 5, characterized in that said breech block contains a trigger bar slide, which, when said breech block moves rearwardly as a result of firing, cooperates with a cam (162) formed on said trigger bar (160), in order to press said cam (162) and thus said trigger bar (160)

downwardly and by this means to disengage said entrainer (161) of said trigger bar (160) from said operational edge (141) of said release device (140).

9. The trigger system as defined in claim 1, characterized in that said hammer (110) can be caused to move back by a rearwardly moving breech block and thus to rotate, by which means the end face (111) of the hammer is pressed against said front surface (121) of said striker and the striker (120) is likewise caused to rotate, and consequently said main spring (170) of said tensioning cam (123) of said rotating striker (120) is cocked.

10. The trigger system as defined in claim 9, characterized in that during a rearward movement of said breech block, a trigger bar slide cooperates with a cam (162) formed on said trigger bar (160) to press said cam (162) and thus said trigger bar (160) downwardly and by this means to disengage said entrainer (161) of said trigger bar (160) from said operational edge (141) of said release device (140), in order that the action of said release spring (190) can initiate rearward rotation of said release device (140), by means of which said releaser protuberance (142) can be returned to a rest position, in which said striker catch (122) is locked in position by said sear edge (131).

11. The trigger system as defined in claim 10, characterized in that said release spring (190) is likewise mounted for rotation about said common principal axis (180) and can be rotatively cocked and biases, with its first end (191), the stop member of said hammer (110) in the direction of said entrainer of said trigger bar (160) and, with its other end (192), presses said release device (140) into a position in which said cocked striker (120) can be blocked by means of said sear (130).

12. The trigger system as defined in claim 1, characterized in that a hammer slide protuberance (114) disposed opposite an impact surface (113) of said hammer (110) can be moved forward by a rearward movement of said hammer (110) in order to press the adjacent entrainer (161) and thus the trigger bar (160) forward against the force of a trigger spring (151).

13. The trigger system as defined in claim 12, characterized in that during a forward movement of a breech block caused by the action of a breech spring, the trigger bar slide causes, together with an entrainer spring (163), a rearward upward movement of said entrainer (161), wherein said entrainer (161) as a result slides upwardly along said hammer slide protuberance (114) whilst pressing against said hammer slide protuberance (114).

14. The trigger system as defined in claim 13, characterized in that said entrainer (161) of said trigger bar (160) causes, due to the action of said trigger spring (151), said hammer slide protuberance (114) to move rearwardly in order to force said hammer (110) to move forward by rotation toward its rest position.

15. The trigger system as defined in claim 12, characterized in that the rest position of a rear edge (112) of said hammer (110) can be adjusted by adaptation of the length of said trigger bar (160) and thus of the relative position of said entrainer (161) with reference to said hammer slide protuberance (114) and of the geometry of said hammer slide protuberance (114) in the range of from 0° (vertical) to ±10°.

16. The trigger system as defined in claim 1, characterized in that said sear (130) is mounted for rotation about a sear axis (131) parallel to said principal axis (180).

17. A method for operating the trigger system of claim 1, the method comprising actuating said trigger (150) wherein:

the actuating of the trigger moves said trigger bar (160) forward;

the forward movement of the trigger bar causes rotation of the release device (140) about said common principal axis (180);

said rotation of the release device causes the release device to contact the sear to rotate the sear;

the rotation of the sear unlatches a striker catch from the sear;

the unlatching allows the striker (120) biased by the main spring (170) to rotate to cause the hammer to rotate about said common principal axis.

18. The method of claim 17 wherein the rotation of the hammer is opposite the rotation of the release device.

* * * * *